US011485622B2

(12) United States Patent
Waltenspül

(10) Patent No.: US 11,485,622 B2
(45) Date of Patent: Nov. 1, 2022

(54) CAN OPENER

(71) Applicant: Kuhn Rikon AG, Rikon im Tösstal (CH)

(72) Inventor: Marco Waltenspül, Rikon (CH)

(73) Assignee: Kuhn Rikon AG, Rikon im Tosstal (CH)

( * ) Notice: Subject to any disclaimer, the term of this patent is extended or adjusted under 35 U.S.C. 154(b) by 0 days.

(21) Appl. No.: 17/379,889

(22) Filed: Jul. 19, 2021

(65) Prior Publication Data

US 2022/0017344 A1 Jan. 20, 2022

(30) Foreign Application Priority Data

Jul. 20, 2020 (EP) ..... 20186749

(51) Int. Cl.
*B67B 7/46* (2006.01)
*B67B 7/70* (2006.01)

(52) U.S. Cl.
CPC ..... *B67B 7/34* (2013.01); *B67B 7/32* (2013.01); *B67B 2007/303* (2013.01)

(58) Field of Classification Search
CPC .... B67B 7/34; B67B 7/32; B67B 7/00; B67B 7/30; B67B 2007/303
USPC ..... 30/417, 400, 416, 418–427
See application file for complete search history.

(56) References Cited

U.S. PATENT DOCUMENTS 6,088,921 A * 7/2000 Valento ..... B67B 7/34 30/410
6,671,970 B2 * 1/2004 Chong ..... B67B 7/34 30/418
7,926,137 B2 * 4/2011 Walters-Olaru ..... B67B 7/32 7/110

FOREIGN PATENT DOCUMENTS

GB 2341378 A 3/2000
WO WO-00/17088 A1 3/2000

OTHER PUBLICATIONS

European Search Report dated Feb. 23, 2021 in Related European Appl. No. 20186749.6 (8 pgs.).

* cited by examiner

*Primary Examiner* — Phong H Nguyen
(74) *Attorney, Agent, or Firm* — Foley & Lardner LLP

(57) ABSTRACT

A can opener (1) for opening a can (2) comprises a rotating device (4), a body (5), a traction device (6), a removal device (8) comprising at least one engagement element (9), and a cutting device (7). The traction device (6) is configured to adapt at least a traction device cutting position (tc) and a traction device lifting position (tl). The traction device (6) in the traction device cutting position (tc) and the cutting device (7) are arranged so as to open a can (2). The traction device (6) in the traction device lifting position (tl) and the engagement element (9) in a removal device lifting position (rl) are arranged such as to engage a lid (3) of an opened can (2). An actuation of the removal device (8) t removes an engagement between the traction device (6) and the engagement element (9) with the lid (3).

17 Claims, 10 Drawing Sheets

CAN OPENER

CROSS REFERENCE TO RELATED APPLICATIONS

This application claims priority to European Appl. No. EP20186749.6, filed Jul. 20, 2020; the contents of which are incorporated by reference herein in their entirety.

TECHNICAL FIELD

The present invention relates to a can opener according to claim 1 and to a method of producing a can opener according to claim 15.

PRIOR ART

Can openers are well-known in the art and are used to open cans by separating the lid from the can body. After the can has been opened, the lid is removed from the can opening such that the user has access to the interior of the can. Typically, the lid of the can comprises remains of the inside such as food, wherein the fingers of a user can get soiled upon the removal the lid. Furthermore, because the opened lids usually comprise a sharp edge there is the risk that the user cuts itself and is insured upon the removal.

U.S. Pat. No. 6,671,970 B2 discloses a can opener comprising a can lifter which comprises a can lid top contact member and a can lid lifting pin that cooperates with the can lid top contact member to grip a can lid and a can seam of a cut can lid. In particular, the lid top contact fits against the interior side of a can seam and the lid lifting pin contacts and catches the underside of the exterior of the seam. Once the lid top contact member and the lid lifting pin are secured to the seam of the lid, an operator can lift the lid from the can. A disadvantage of this solution is the fact that the lid still has to be touched by the user in order to remove the lid from the can opener after it has been lifted from the can. The risk of soiling or injury therefore remains.

SUMMARY OF THE INVENTION

It is an object of the present invention to overcome the disadvantages of the prior art. In particular, it is an object to provide a can opener that allows a can to be opened without a user having to touch the lid.

A can opener for opening a can is provided, wherein the can opener comprises a rotating device, a body, a traction device, and a cutting device. The rotating device is rotatably arranged on the body and is configured to rotate about a rotation axis along a first rotation direction and along a second rotation direction running opposite to the first rotation direction. The traction device is arranged on the body and is configured to adapt at least a traction device cutting position upon rotation of the rotating device along the first rotation direction and to adapt a traction device lifting position upon rotation of the rotating device along the second rotation direction. The traction device in the traction device cutting position and the cutting device are arranged so as to open a can. The can opener further comprises a removal device comprising at least one engagement element. The traction device in the traction device lifting position and the engagement element in a removal device lifting position are arranged such as to engage a lid of an opened can. The can opener is further configured such that an actuation of the removal device transfers the traction device into a traction device release position and the removal device into a removal device release position, whereby an engagement between the traction device and the engagement element with the lid is removed.

That is, it is preferred that the can opener can adapt several positions, namely at least a cutting position, a lifting position, and a release position. In the cutting position of the can opener, the can opener is configured to open a can. In the lifting position of the can opener, the can opener is configured to lift a lid of the opened can away. In the release position, the can opener is configured to release the lifted lid from the can opener so that the lid can be disposed, for example. To this end the user does not have to touch the lid. Instead, the can opener is configured to automatically release the removed lid when the removal device is actuated by the user. Consequently, a risk of soiling or injury of the user is eliminated. After a lid has been released from the can opener, the can opener can be used to open another can. Hence, the release position can also be referred to as an initial position, i.e. the position in which the can opener can be placed on a can to be opened.

During the various positions of the can opener certain components of the can opener can adapt different positions, as well. In fact, in the cutting position of the can opener the traction device is in the traction device cutting position, wherein the traction device is configured and arranged such that the traction device and the cutting device can open a can. Namely, once the traction device is in the traction device cutting position the can can be opened by further rotating the rotating device about the rotation axis along the first rotation direction, During this process a side wall of the can is drawn through a gap being established between the traction device and the cutting device so that the side wall of the can is progressively cut.

In the lifting position of the can opener the traction device is in the traction device lifting position and the removal device is in the removal device lifting position, wherein the traction device and the engagement element are arranged such as to engage the lid of the opened can. In the release position of the can opener the traction device is in the traction device release position and the removal device is in the removal device release position, whereby the engagement between the traction device and the engagement element with the lid is removed and, consequently, the lid is released from the can opener. As already mentioned, the release position of the can opener can also be referred to as an initial position. Thus, the traction device release position and the removal device release positions can likewise be referred to as traction device initial position and as removal device initial position, i.e. initial positions of these components in which these components can be placed on a can to be opened.

The engagement element is preferably movably arranged on the body and is movable with respect to the body upon rotation of the rotating device about the rotation axis along the first rotation direction when the removal device is transferred into the removal device cutting position, wherein the engagement element is arranged such as to act on the can to be opened by the traction device in the traction device cutting position and the cutting device. The engagement element can act on the can to be opened by the traction device and the cutting device by being arranged in a cutting edge along which the can is cut by the traction device and the cutting device. Preferably, and as will be explained in greater detail below, the engagement element is preferably pressed towards the traction device in the traction device cutting position and the cutting device.

Additionally or alternatively, the engagement element is preferably movably arranged on the body and is movable with respect to the body upon rotation of the rotating device about the rotation axis along the second rotation direction when the removal device is transferred into the removal device lifting position.

To this end it is particularly preferred that the engagement element is displaceably arranged on the body, wherein a rotation of the rotating device along the first rotation direction and/or along the second rotation direction results in a displacement of the engagement element along the body. In fact, the engagement element is preferably moveable or displaceable towards and away from the cutting device upon rotation of the rotating device. In particular, the engagement element can be moveable towards the cutting device upon rotation of the rotating device along the first rotation direction when the removal device is transferred into its removal device cutting position. Additionally, the engagement element can be moveable or displaceable away from the cutting device upon rotation of the rotating device along the second rotation direction when the removal device is transferred from its removal device cutting position into its removal device lifting position. Moreover, the engagement element can be further moveable away from the cutting device upon actuation of the removal device and when the removal device is transferred from its removal device lifting position into its removal device release position, i.e. into the removal device initial position. If a user wishes to open another can and rotates the rotating device along the first rotation direction, the removal device is transferred from its removal device release position into its removal device cutting position. The engagement element preferably performs a curved displacement with respect to the body, particularly preferably within an elongated hole or recess being provided in the body. The engagement element is preferably movable with respect to the body within a plane running perpendicularly to the rotation axis.

A lateral distance between the cutting device and the traction device in the traction device cutting position is preferably smaller than a lateral distance between the cutting device and the traction device in the traction device lifting position. Additionally or alternatively a lateral distance between cutting device and the traction device in the traction device lifting position is preferably smaller than a lateral distance between the cutting device and the traction device release position. A lateral distance between the cutting device and the engagement element in the removal device cutting position is preferably larger than a lateral distance between the cutting device and the engagement element in the removal device lifting position. Namely, if a can is opened by the can opener, the lateral distance between the cutting device and the engagement element in the removal device cutting position is preferably larger than a lateral distance between the cutting device and the engagement element in the removal device lifting position. Additionally or alternatively a lateral distance between the cutting device and the engagement element in the removal device lifting position is preferably smaller than a lateral distance between the cutting device and the engagement element in the removal device release position. A lateral distance between the traction device in the traction device lifting position and the engagement element in the removal device lifting position is preferably smaller than a lateral distance between the traction device in the traction device cutting position and the engagement element in the removal device cutting position. Additionally or alternatively a lateral distance between the traction device in the traction device lifting position and the engagement element in the removal device lifting position is preferably smaller than a lateral distance between the traction device in the traction device release position and the engagement element in the removal device release position. The above-mentioned lateral distances are preferably determined in each case between the respective (figurative) center points of the traction device, the cutting device, and the engagement element, respectively. The center point is understood as a point being centrally with respect to an outer circumference of the traction device, the cutting device, and the engagement element, respectively. For example, if the traction device or the cutting device or the engagement element has a circular cross-section, the center point would correspond to the respective circle center.

The removal device is preferably swivably arranged on the body and is configured to swivel about a swivelling axis running parallel to the rotation axis. Hence, an actuation of the removal device preferably corresponds to a swivelling of the removal device about the swivelling axis.

The removal device preferably comprises a lever that is operatively connected to the engagement element such, that a swivelling of the lever moves the engagement element with respect to the body.

To this end it is conceivable that the engagement element corresponds to a pin or bolt which is arranged within a through-opening or recess of the lever as well as within the elongated hole or recess provided in the body, see above. In this case the swivelling movement of the lever is transferred onto the engagement element, which engagement element thereby travels along the elongated hole or recess.

The can opener preferably further comprises a removal device biasing means that biases the removal device into the removal device cutting position and/or that biases the removal device into the removal device lifting position. In other words, the removal device biasing means is preferably arranged and configured such that it pushes the removal device out of its removal device release position, i.e. out of its removal device initial position. The removal device biasing means preferably corresponds to a spring, particularly preferably to a leg spring, that is connected to the body as well as to the removal device, in particular to the lever.

The can opener preferably further comprises a traction device biasing means that biases the traction device into the traction device release position, i.e. into the traction device initial position. In other words, the traction device biasing means is preferably arranged and configured such that it pushes the traction device out of its traction device cutting position and/or out of its traction device lifting position. The traction device biasing means likewise preferably corresponds to a spring, particularly preferably to a leg spring, wherein said spring is preferably connected to the body as well as to the traction device.

The can opener preferably further comprises an abutment device. The abutment device is preferably configured and arranged such that, when the traction device is in its traction device release position, the abutment device adapts at least a first abutment position and abuts against the removal device, in particular against the lever, whereby the removal device remains in its removal device release position. Additionally or alternatively the abutment device is preferably configured and arranged such that, upon rotation of the rotating device about the rotation axis along the first rotation direction, the abutment device adapts an unblocking position, whereby the removal device is transferable into its removal device cutting position. The abutment device is preferably configured and arranged to act against the removal device biasing means. This is preferably achieved via an abutment that is established between an abutment surface on the abutment device and a corresponding abutment surface on the removal device, in particular on the lever. These abutment surfaces are preferably provided by correspondingly designed engagement elements such as a recess in the lever and a projection that can be received in said recess on the abutment device. It can be said that an engagement between the abutment device in its abutment position and the removal device, in particular the lever, is established, Upon rotation of the rotating device about the rotation axis along the first rotation direction, this engagement is released and, due to the biasing force exerted by the removal device biasing means, the removal device is transferred from its removal device release position into the removal device cutting position. The abutment device is preferably rotatable about a further rotation axis extending parallel to the rotation axis. Additionally or alternatively the abutment device is preferably non-displaceable with respect to the body. The abutment device preferably adapts its abutment position and/or its unblocking position upon rotation of the abutment device about the further rotation axis.

The abutment device is preferably configured and arranged such, that the traction device is transferable from its traction device lifting position into its traction device release position upon actuation of the removal device. Additionally or alternatively the abutment device is preferably configured and arranged such, that it adapts a second abutment position when the traction device is in its traction device lifting position, whereby the abutment device prevents the traction device from being transferred into its traction device release position. To this end it is particularly preferred that the actuation of the removal device enables a transfer of the abutment device out of its second abutment position, whereby the traction device can transfer from the traction device lifting position into the traction device release position.

The can opener preferably further comprises an abutment device biasing means that biases the abutment device into its abutment position in the absence of a rotation of the rotating device. In other words, when the can opener is in its release position or initial position, the abutment device preferably is in its abutment position. The abutment device biasing means preferably corresponds to a spring and/or preferably is attached to the body and the abutment device.

The abutment device can comprise a trigger element that is in connection with the traction device when the traction device is in its traction device release position, and wherein the traction device presses against the trigger element upon rotation of the rotating device along the first rotation direction so as to displace the trigger element, whereby the abutment device is moved out of its abutment with the removal device. Said connection preferably corresponds to a contact between the traction device and the trigger element that is established when the traction device is transferred from its traction device release position into its traction device cutting position. In fact, during this displacement the traction device presses against the trigger element, whereupon the abutment device is rotated about its further rotation axis. Said rotation of the abutment device results in a removal of the abutment being established between the abutment device and the removal device. In particular, the engaging elements provided on the lever and on the abutment device are moved out of engagement with one another. Because then the abutment device can no longer act against the biasing force exerted by the removal device biasing means, the removal device is swivelled about the swivelling axis and is transferred from its removal device release position into its removal device cutting position. Additionally or alternatively it is preferred that the trigger element abuts against the traction device when the traction device is in its traction device lifting position. That is, the trigger element preferably provides the abutment that keeps the traction device in its traction device lifting position. However, the abutment device is preferably configured and arranged such that it is rotatable about its further rotation axis upon actuation of the removal device. Thus, when the removal device is actuated said actuation causes a rotation of the abutment device about its further rotation axis, whereby the trigger element is rotated as well, and whereby the abutment between the trigger element and the traction device in its traction device lifting position is removed.

The removal device preferably comprises an actuating element, and wherein the actuating element is configured and arranged such that, when the traction device is in its traction device lifting position, it presses against the traction device upon actuation of the removal device. During the process the actuating element preferably presses the traction device from its traction device lifting position into its traction device release position. The actuating element thus assists in the transfer of the traction device from its traction device lifting position into its traction device release position. Said actuating element preferably corresponds to a protrusion being provided on the lever and which protrusion extends from the lever towards the traction device.

The traction device is preferably movably arranged on the body and is movable with respect to the body upon rotation of the rotating device about the rotation axis along the first rotation direction into the traction device cutting position and/or along the second rotation direction into the traction device lifting position. To this end it is particularly preferred that the traction device is displaceably arranged on the body, wherein a rotation of the rotating device along the first rotation direction and/or along the second rotation direction results in a displacement of the traction device along the body. In fact, the traction device is preferably moveable or displaceable towards and away from the cutting device upon rotation of the rotating device. In particular, the traction device can be moveable towards the cutting device and into its traction device cutting position upon rotation of the rotating device along the first rotation direction. Additionally, the traction device can be moveable away from the cutting device and into its traction device lifting position upon rotation of the rotating device along the second rotation direction. The traction device is preferably movable or displaceable with respect to the body within a plane running perpendicularly to the rotation axis. Moreover, the traction device is further moveable away from the cutting device upon actuation of the removal device. In fact, and as already explained above, the actuation of the removal device results in a swivelling of the lever about the swivelling axis, which in turn results in a rotation of the abutment device about its further rotation axis, whereby the abutment established between the trigger element and the traction device is removed.

If a user wishes to open another can and rotates the rotating device along the first rotation direction, the traction device is again transferred from its traction device release position or traction device initial position into its traction device cutting position.

To this end it is preferred that the traction device further comprises an eccentric that is comprised of an eccentric sheave and a rotating axle, and wherein the traction device preferably is in connection with the rotating device via the eccentric. In this case a rotation of the rotating device is transferable into a movement or displacement of the traction device with respect to the body. The traction device preferably performs a curved displacement with respect to the body, particularly preferably within an elongated hole or recess being provided in the body.

The cutting device is preferably rotatably arranged on the body and is configured to rotate about a further rotation axis. The further rotation axis about which the cutting device rotates preferably extends parallel to or inclined with respect to the rotation axis about which the rotating device rotates. Additionally or alternatively the cutting device is preferably non-displaceable with respect to the body. The traction device preferably comprises a traction wheel as it is known in the art. The traction wheel is preferably arranged on the rotating axle of the eccentric such that a rotation of the rotating device results in a rotation of the rotating axle, which in turn results in a displacement of the traction wheel. The rotating device preferably comprises a handle, and wherein the handle is preferably arranged on the rotating axle of the eccentric. The cutting device preferably comprises a cutting wheel as it is known in the art, it is furthermore preferred that the can opener comprises at least one grip that is in connection with the body and which is grippable by a user. The body preferably defines an upper side and an opposite lower side, wherein the rotating device is preferably arranged on the upper side and the traction device and the cutting device are preferably arranged on the lower side. The grip preferably extends laterally from the body, i.e. along a plane running parallel to the plane along which the engagement element and/or the traction device are displaceable with respect to the body. The can opener therefore preferably corresponds to a can opener than can be placed on the top of a can to be opened.

In a further aspect a method of producing a can opener, preferably a can opener as described above is provided, wherein the method comprises the steps of i) providing a rotating device, ii) providing a body, iii) providing a traction device, and iv) providing a cutting device. The rotating device is rotatably arranged on the body and is configured to rotate about a rotation axis along a first rotation direction and along a second rotation direction running opposite to the first rotation direction. The traction device is arranged on the body and is configured to adapt at least a traction device cutting position upon rotation of the rotating device along the first rotation direction and to adapt a traction device lifting position upon rotation of the rotating device along the second rotation direction. The traction device in the traction device cutting position and the cutting device are arranged so as to open a can. The method further comprises the step of v) providing a removal device comprising at least one engagement element. The traction device in the traction device lifting position and the engagement element in a removal device lifting position are arranged such as to engage a lid of an opened can. The can opener is further configured such that an actuation of the removal device transfers the traction device into a traction device release position and the removal device into a removal device release position, whereby an engagement between the traction device and the engagement element with the lid is removed.

It should be noted that the steps i) to v) can be carried out in any desired sequence. Furthermore, it should be noted that any explanations provided with respect to the can opener per se likewise apply to the method of producing a can opener, and vice versa.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

FIG. 5*c* shows a partial sectional view of the can opener according to FIG. 6*a* taken on the line indicated by arrow B in FIG. 4;

DESCRIPTION OF PREFERRED EMBODIMENTS

With respect to the figures various aspects of a can opener 1 for opening a can 2 are discussed.

Figure 1:
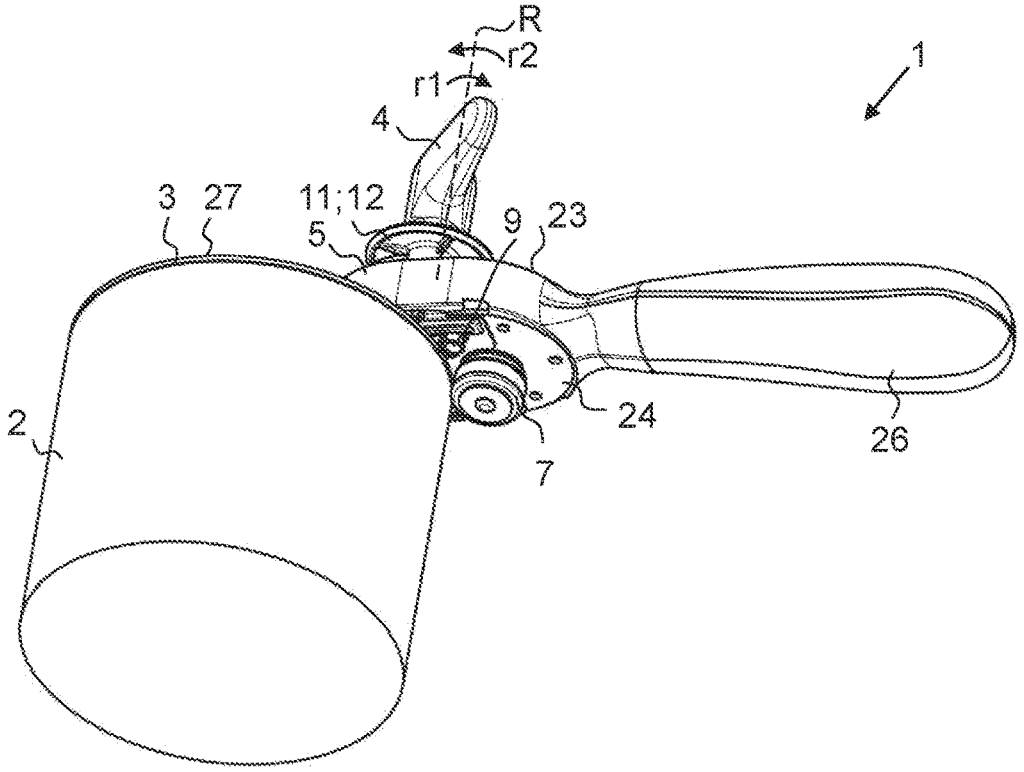
FIG. 1 shows a perspective view of a can opener applied on a can to be opened in a cutting position.
Figure 2:
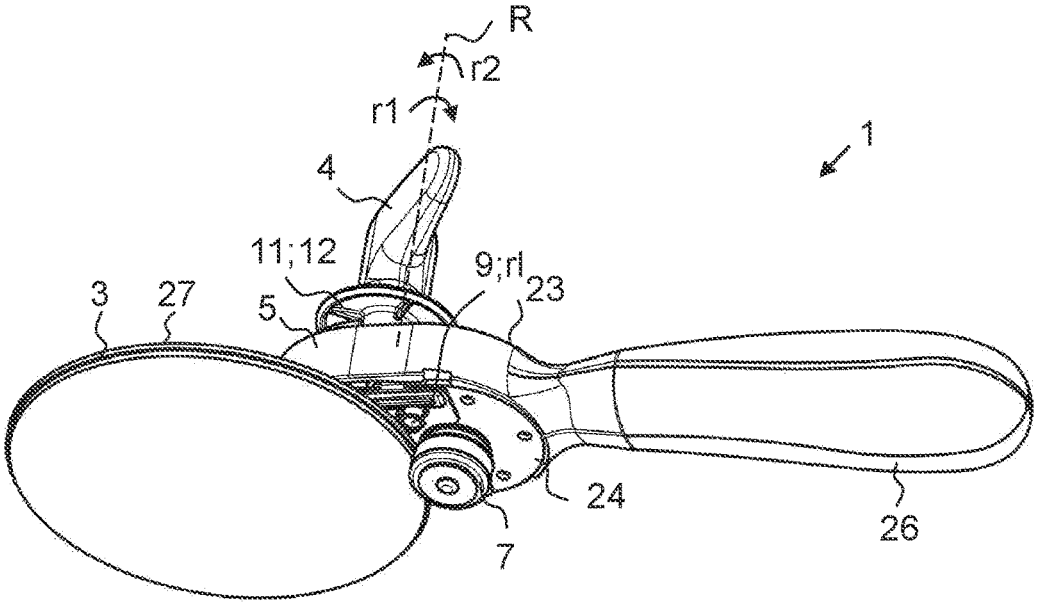
FIG. 2 shows a perspective view of the can opener according to FIG. 1 in a lifting position lifting a lid of the can.

In particular, the can opener 1 according to the invention comprises a rotating device 4 in the form of a handle, a body 5; a traction device 6 comprising a serrated traction wheel 22, a cutting device 7 comprising a cutting wheel 25, and a removal device 8. The body 5 is here of an essentially oval shape and defines an upper side 23 and an opposite lower side 24, wherein the rotating device 4 is arranged on the upper side 23 and the traction wheel 22 and the cutting wheel 25 are arranged on the lower side 24, respectively. An elongate grip 26 extends laterally from the body 5, which grip 26 is configured to be graspable by the hand of a user. As best seen in FIG. 1, this configuration allows the can opener 1 to be placed on the top 27 of a can 1 to be opened, wherein the cutting wheel 25 and the traction wheel 22 are facing the top 27 of the can 2, and wherein the rotating handle 4 is facing away from the can 2 and towards an outside. After the can 2 has been opened, the can opener 1 allows a removal of the lid 3 of the opened can 2 as depicted in FIG. 2.

The can opener 1 can adapt several positions, namely at least a cutting position, a lifting position, and a release position. The cutting position of the can opener 1 is depicted in FIGS. 1, 7*a* to 7*c* and 9*b*. The lifting position of the can opener 1 is depicted in FIGS. 2, 8*a* to 8*c* and 9*c*, The release position of the can opener 1 is depicted in FIGS. 6*a* to 6*c* and 9*a*. In the cutting position of the can opener 1, the can opener 1 is configured to open a can 2. In the lifting position of the can opener 1, the can opener 1 is configured to lift the lid 3 of the opened can 2 away from a can opening. In the release position, the can opener 1 is configured to release the lifted lid 3 from the can opener 1 so that the lid 3 can be disposed, for example. To this end the user does not have to touch the lid 3, instead, the can opener 1 is configured to automatically release the removed lid 3. After the lid 3 has been released from the can opener 1, the can opener 1 can be used to open another can 2. Hence, the release position can also be referred to as an initial position, i.e. the position in which the can opener 1 can be placed on another can 2 to be opened.

Figure 3:
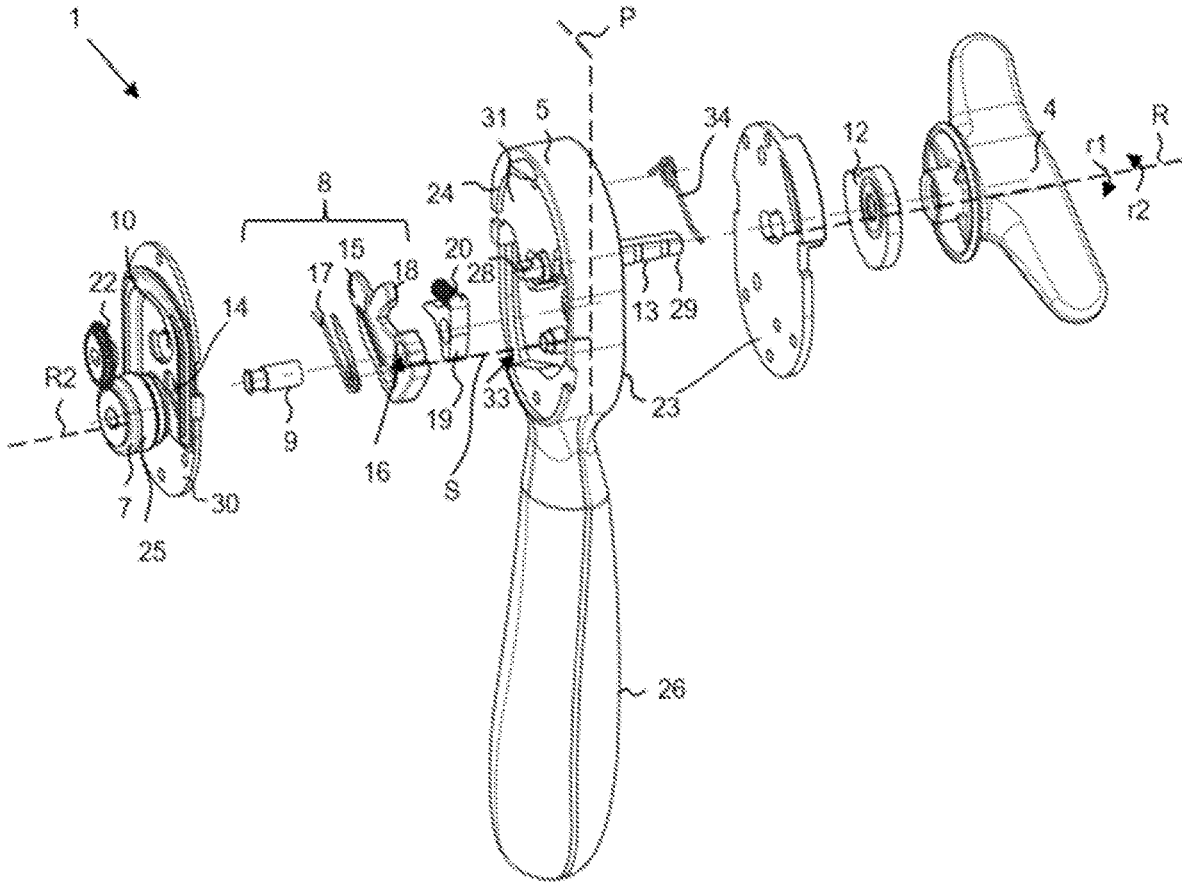
FIG. 3 shows an exploded view of the can opener according to FIG. 1.
Figure 4:
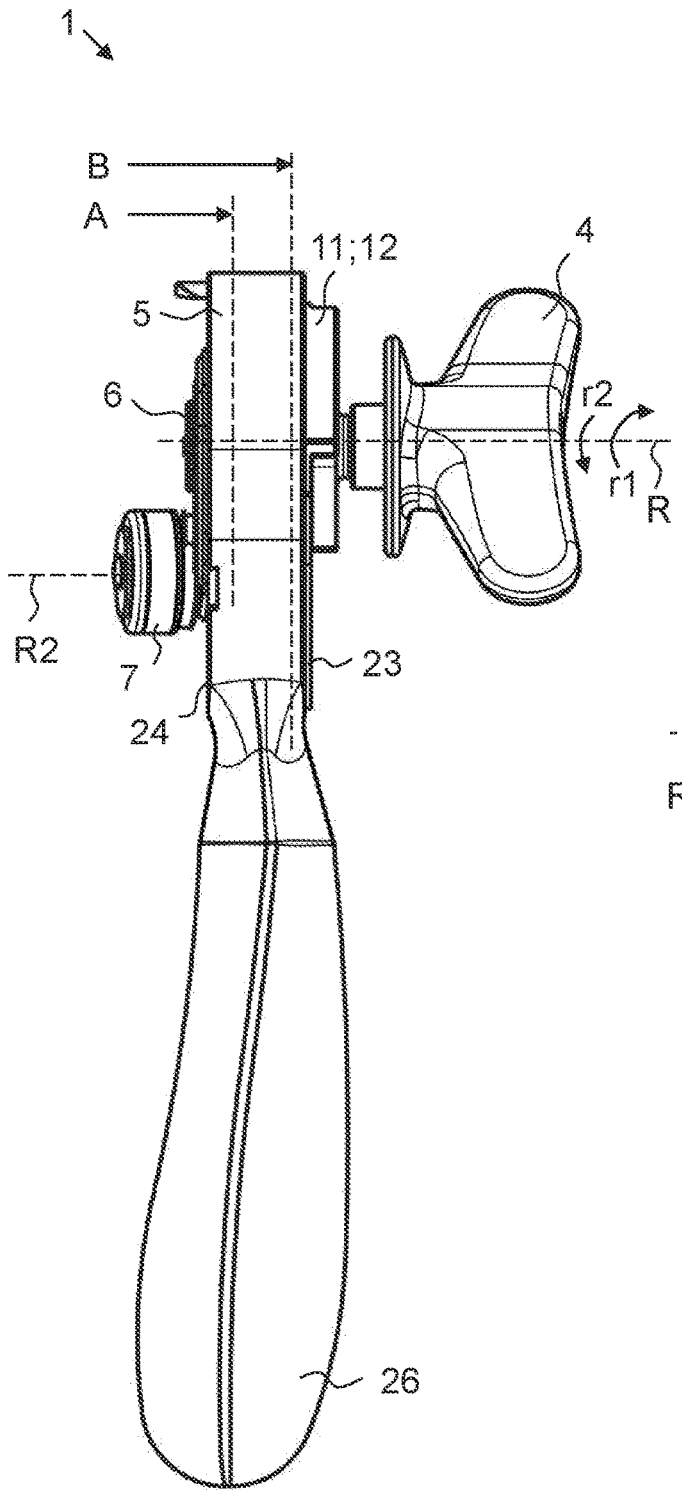
FIG. 4 shows a side view of the can opener according to FIG. 1.
Figure 5:
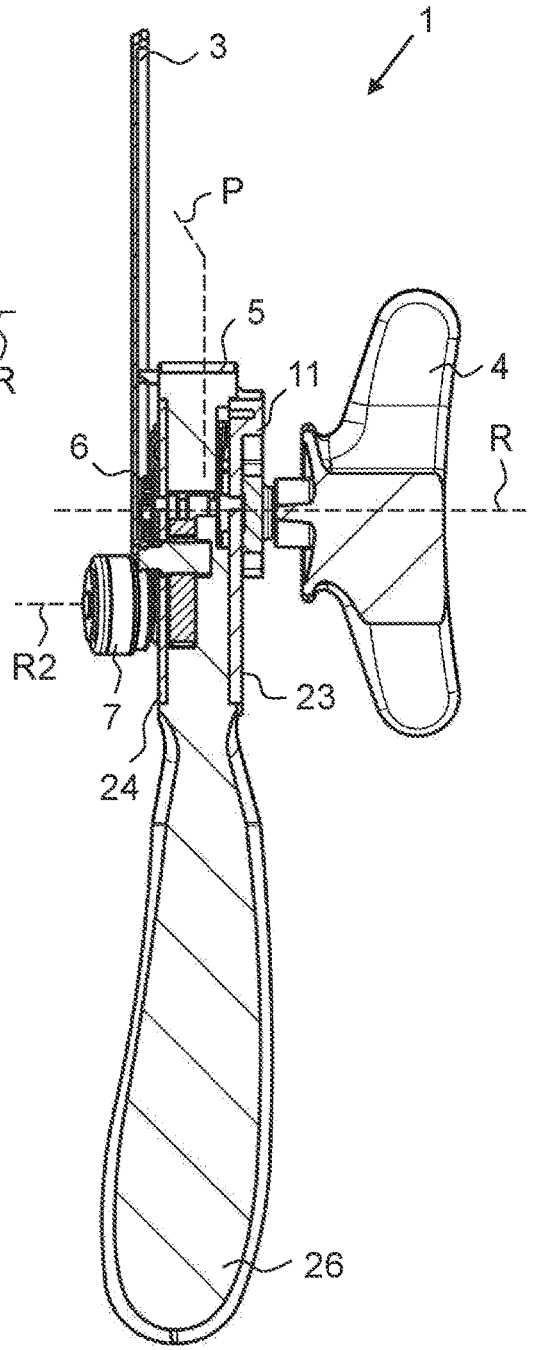
FIG. 5 shows a sectional view of the can opener and the lid according to FIG. 2.

The rotating device 4 is rotatably arranged on the upper side of the body 5 and is configured to rotate about a rotation axis R along a first rotation direction r1 and along a second rotation direction r2 running opposite to the first rotation direction. As best seen in FIG. 3 the traction device 6 further comprises an eccentric 11 that is comprised of an eccentric sheave 12 and a rotating axle 13. The traction wheel 22 is attached on a distal end 28 of the rotating axle 13 and the rotating device 4 is arranged on a proximal end 29 of the rotating axle 13, whereby a rotation of the rotating device 4 is transferable into a displacement of the traction device 6, in particular of the traction wheel 22, with respect to the body 5. A curved elongated hole 10 is provided in the lower side 24 of the body 5, in particular in a plate 30 being inserted into a recess 31 formed in the lower side 24 of the body 5. The traction device 6 is at least partially arranged within said elongated hole 10 and is configured to perform a curved displacement along said elongated hole 10 and thus with respect to the body 5. The cutting device 7 is rotatably arranged on the body 5, in particular on the plate 30 being inserted into the recess 31 in the lower side 24 of the body 5, and is configured to rotate about a further rotation axis R2, which is here arranged slightly inclined with respect to the rotation axis R about which the rotating device 4 rotates. The cutting device 7 is furthermore arranged non-displaceable with respect to the body 5, i.e. it is configured to rotate in situ. The removal device 8 comprises an engagement element 9 and a lever 15. The lever 15 is swivably arranged on the body 5 and is configured to swivel about a swivelling axis S running parallel to the rotation axis R about which the rotating device 4 is rotatable. As best seen in FIGS. 6*a* to 8*c*, a free end 32 of the 15 laterally protrudes from the body 5 of the can opener 1. In particular, the lever 15 is arranged within the body 5 and its free end 32 protrudes out of an aperture 33 formed in the body 5. Said free end 32 is graspable by a user and allows an actuation of the removal device 8 that will be explained in greater detail further below. Already at this point it should however be noted that an actuation of the removal device 8 corresponds to a swivelling of the lever 15 about the swivelling axis S.

The engagement element 9 corresponds here to an essentially cylindrical pin that is arranged within a through-opening 16 of the lever 15 as well as within a curved elongated hole 14 provided in the body 5. Because of this arrangement a swivelling of the lever 15 can be transferred to the engagement element 9, wherein the engagement element 9 travels along the curved elongated hole 14. The displacement performed by the traction device 6 upon rotation of the rotating device 4 takes place within a plane p running perpendicularly to the rotation axis R. Likewise, the swivelling movement of the lever 15 and consequently the displacement of the engagement element 8 takes place within a plane running perpendicularly to the rotation axis R.

Figure 6A:
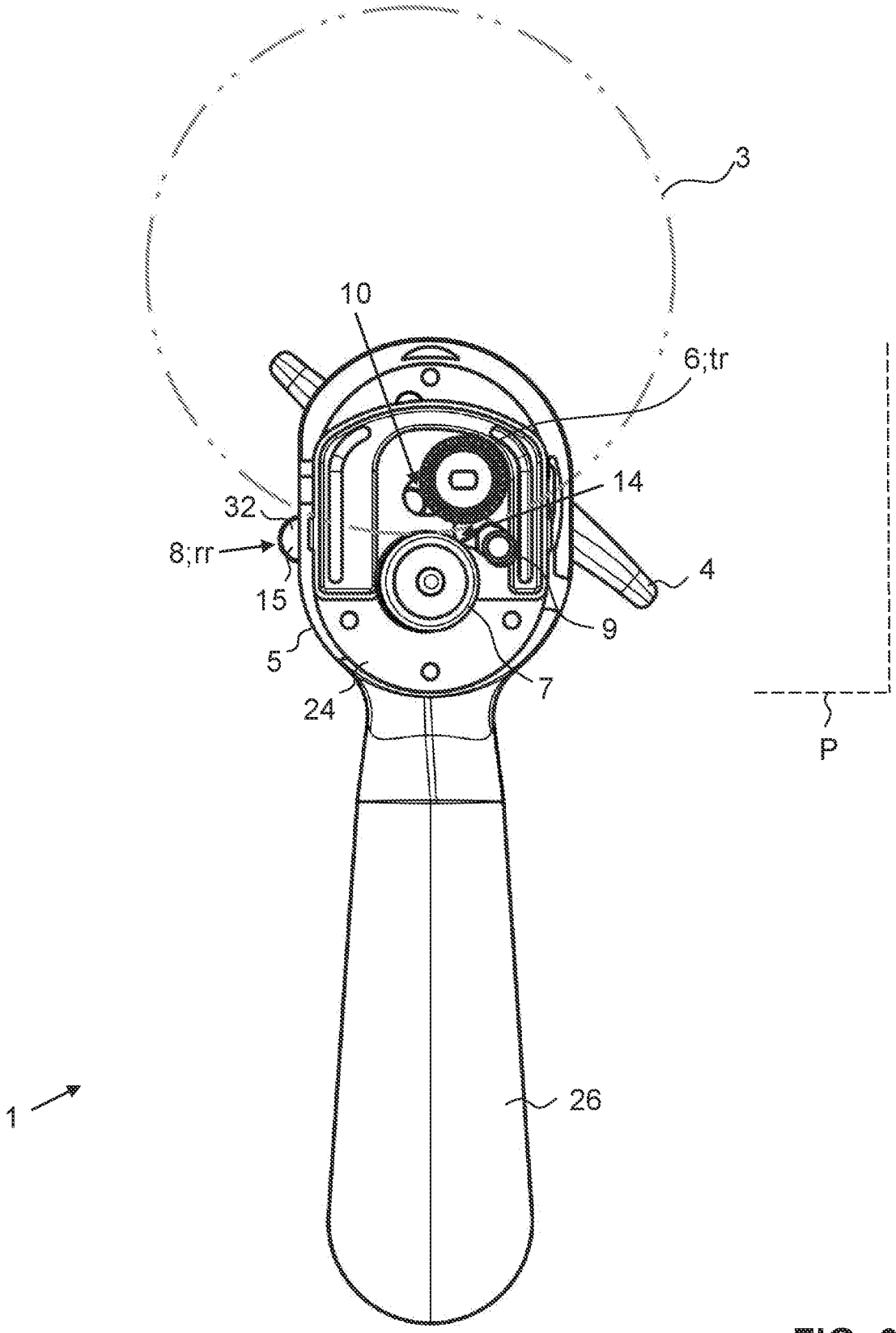
FIG. 6*a* shows a bottom view of the can opener in a release position.
Figure 7A:
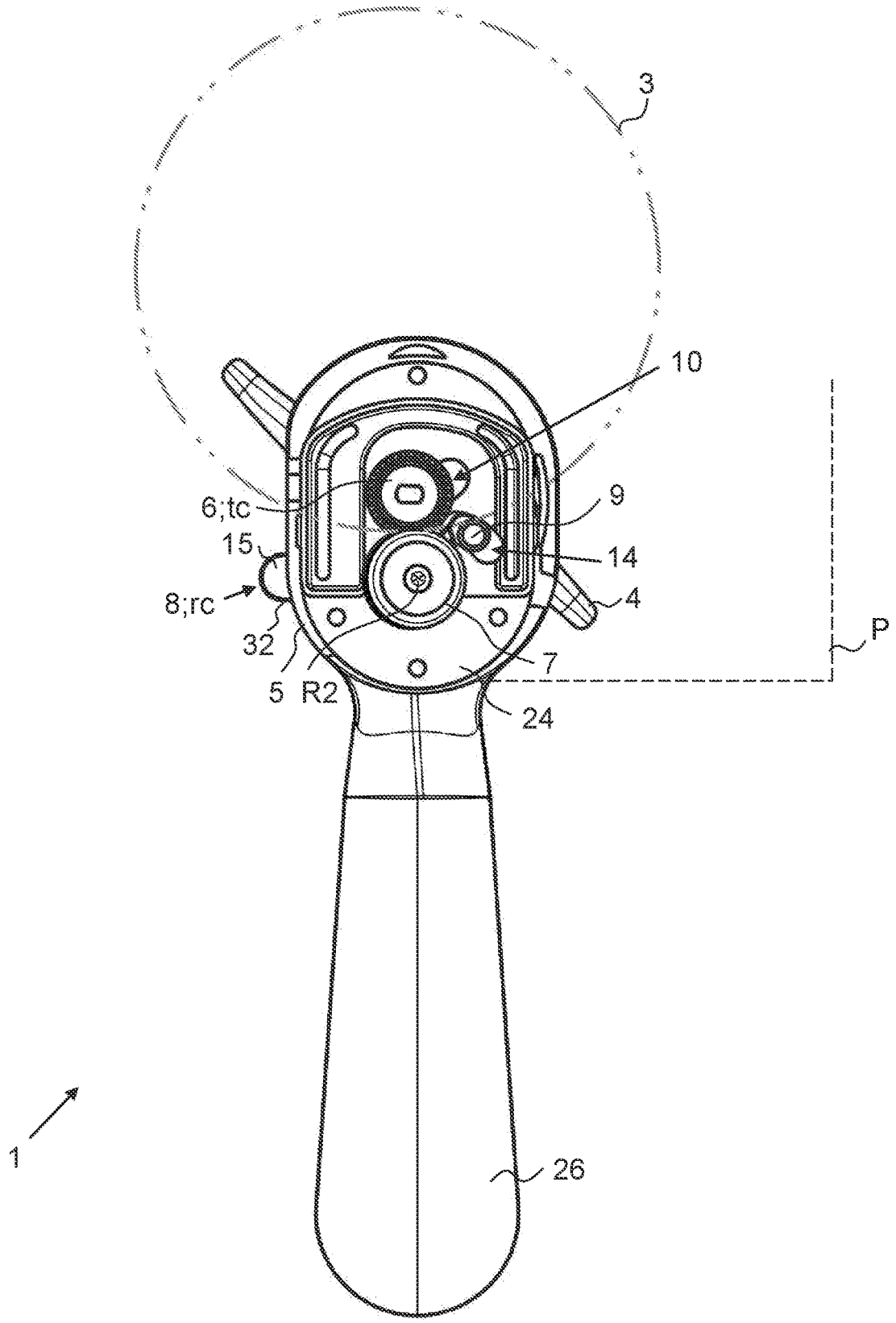
FIG. 7*a* shows a bottom view of the can opener in a cutting position.
Figure 8A:
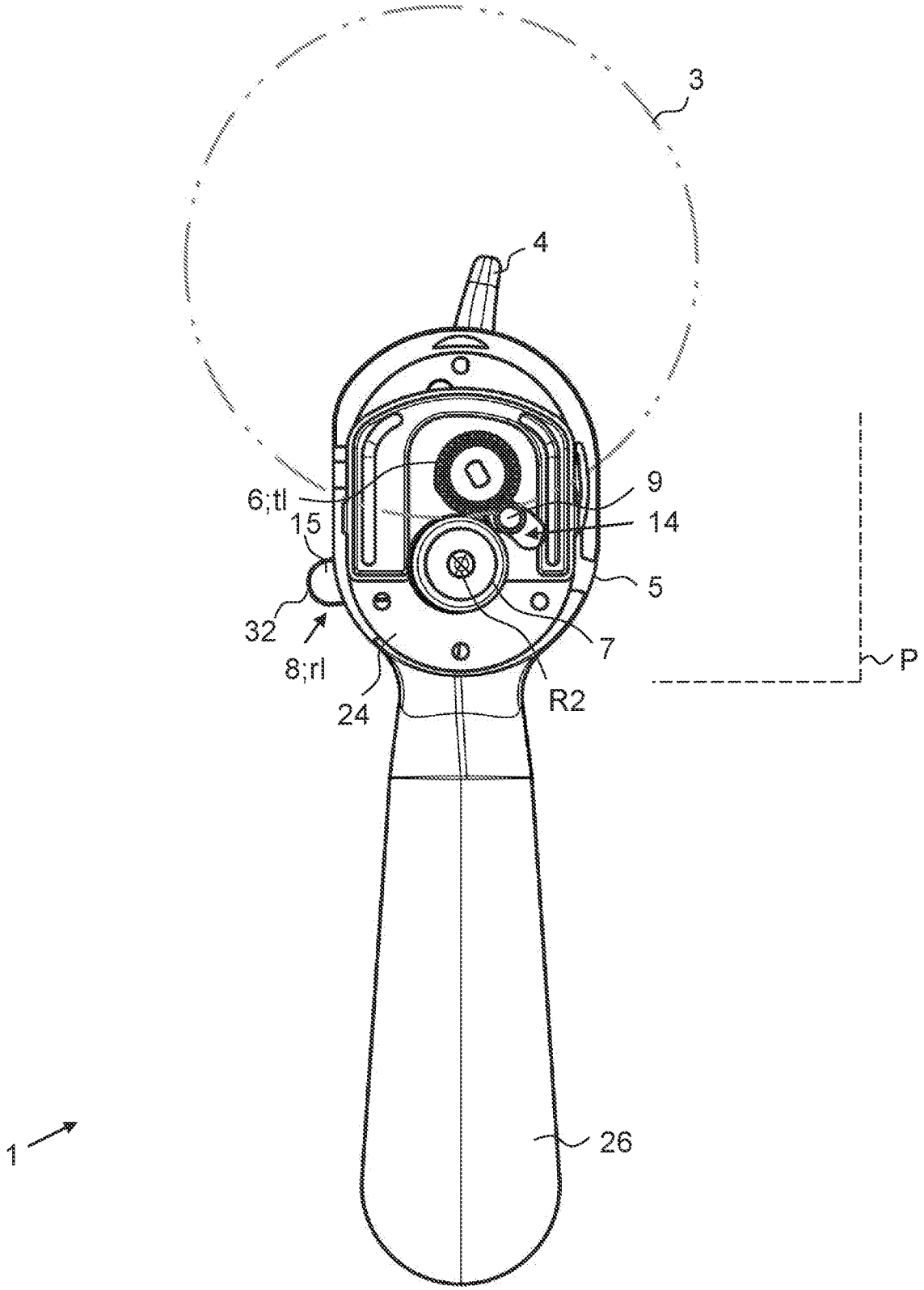
FIG. 8*a* shows a bottom view of the can opener in a lifting position.

Because the traction device 6 and the removal device 8 are movably arranged on the body 5 these components adapt different positions upon a rotation of the rotating device 4 and/or upon an actuation of the removal device 8. These different positions shall be illustrated by means of FIGS. 6*a*, 7*a* and 8*a*. In fact, the traction device 6 is configured to adapt a traction device cutting position tc upon rotation of the rotating device 4 along the first rotation direction r1 and to adapt a traction device lifting position tl upon rotation of the rotating device 4 along the second rotation direction. Furthermore, the traction device 6 is configured to adapt a traction device release position tr upon actuation of the removal device 8. The traction device release position tr can also be referred to as a traction device initial position. The traction device 6 being in its traction device release position tr is depicted in FIG. 6*a*. The traction device 6 being in its traction device cutting position tc is depicted in FIG. 7*a*. The traction device 6 being in its traction device lifting position tl is depicted in FIG. 8*a*. Likewise, the removal devise 8 is configured to adapt a removal device cutting position rc upon rotation of the rotating device 4 about the rotation axis R along the first rotation direction r1 and to adapt a removal device lifting position rl upon rotation of the rotating device 4 about the rotation axis R along the second rotation direction r2. Furthermore, the removal device 8 is configured to adapt a removal device release position rr upon an actuation of the removal device 8. The removal device release position rl can also be referred to as a removal device initial position. Because the engagement element 9 is operatively connected to the lever 15, the engagement element 9 adapts different positions in accordance with the different positions of the removal device 8, in particular in accordance with different swiveling positions adapted by the lever 15. The removal device 8 being in its removal device release position rr is depicted in FIG. 6*a*, The removal device 8 being in its removal device cutting position rc is depicted in FIG. 7*a*. The removal device 8 being in its removal device lifting position rl is depicted in FIG. 8*a*.

As best seen in FIG. 3 the can opener 1 further comprises a removal device biasing means 17 that biases the removal device 8 out of its removal device release position rr and thus into the removal device cutting position rc as well as into the removal device lifting position rl. The removal device biasing means 17 corresponds to a leg spring that is connected on one side to the body 5 and on the other side to the lever 15. The can opener 1 also comprises a traction device biasing means 34 that biases the traction device 6 into the traction device release position tr, i.e. into the traction device initial position, and thus out of its traction device cutting position tc as well as out of its traction device lifting position tl. The traction device biasing means 34 likewise corresponds to a leg spring, wherein one end of said spring is connected to the body 5 and the other end of said spring is connected to the traction device 6.

As follows from FIGS. 3, 6*b*, 7*b* and 8*b*, the can opener 1 further comprises an abutment device 19 and an abutment device biasing means 20. The abutment device 19 is non-displaceably but rotatably arranged on the body 5 and is configured to rotate about a further rotation axis R1 extending parallel to the rotation axis R. The abutment device biasing means 20 biases the abutment device 19 into its abutment position in the absence of a rotation of the rotating device 4 and corresponds here to a spring being attached to the body 5 on one side and to the abutment device 19 on the other side. The abutment device 19 is configured and arranged to act against the removal device biasing means 17.

In particular, the abutment device 19 is configured to adapt an abutment position and an unblocking position upon rotation of the abutment device 19 about the further rotation axis R1, Namely, the abutment device 19 is configured and arranged such that, when the traction device 6 is in its traction device release position tr, the abutment device 19 adapts its abutment position and abuts against the removal device 8, in particular against the lever 15, whereby the removal device 8 remains in its removal device release position rr. To this end an abutment is established between an abutment surface 35 on the abutment device 19 and a corresponding abutment surface 36 on the removal device 8, in particular on the lever 15. These abutment surfaces 35, 36 are provided here by means of a recess 37 formed in the lever 15 and a projection 38 formed on the abutment device 19 and being receivable in the recess 37 of the lever 15. This situation is depicted in FIG. 6*b*.

The abutment device 19 is furthermore configured and arranged such that, upon rotation of the rotating device 4 about the rotation axis R along the first rotation direction r1, the abutment device 19 adapts an unblocking position, whereby the removal device 8 is transferred into its removal device cutting position rc. To this end the engagement between the abutment device 19 and the removal device 8 is released and, due to the biasing force exerted by the removal device biasing means 17, the removal device 8 is transferred from its removal device release position rr into the removal device cutting position rc. This situation is depicted in FIG. 7*b*. Moreover, and as seen in FIG. 6*b*, the abutment device 19 comprises a trigger element 21 that is in connection with the traction device 6 when the traction device 6 is in its traction device release position tr. The trigger element 21 corresponds here to a protruding arm that protrudes from the abutment device 19 towards the traction device 6 when the traction device 6 is in its traction device release position tr. In this position the trigger element 21 by the rotating axle 13 of the eccentric 11. Upon rotation of the rotating device 4 along the first rotation direction r1 the traction device 6 is moved along the curved elongated hole 10, wherein the rotating axle 13 presses against the trigger element 21. Because the abutment device 19 is rotatably mounted on the body 5 the pressing force exerted by the rotating axle 13 results in a rotation of the trigger element 21 and, consequently of the abutment device 19, whereby the abutment device 19 is moved out of its abutment with the removal device 8. Because the abutment device 19 can no longer act against the biasing force exerted by the removal device biasing means 17, the removal device 8 is swivelled about the swivelling axis S and is transferred from its removal device release position rr into its removal device cutting position rc, see FIGS. 6*b* and 7*b*.

Moreover, and as follows from FIG. 8*b*, in the absence of an actuation of the removal device 8 the lever 15 pushes the trigger element 21 into a second abutment position, wherein the trigger element 21 provides an abutment for the traction wheel 22 such that the traction wheel 22 and consequently the traction device 6 is prevented from transferring into the traction device release position tr. In the event that the user actuates the removal device 8 by pushing the lever 15 towards a front side of the can opener, the thus caused swivelling of the removal device 8 allows the abutment device 19 to rotate about its further rotation axis R1 as a consequence of the biasing force exerted by the abutment device biasing means 20. This rotation in turn removes the abutment between the trigger element 21 and the traction wheel 22 such that the traction device 6 is transferred from its traction device lifting position tl into its traction device release position tr by the biasing force exerted by the traction device biasing means 34, see FIG. 8*c*.

Figure 6B:
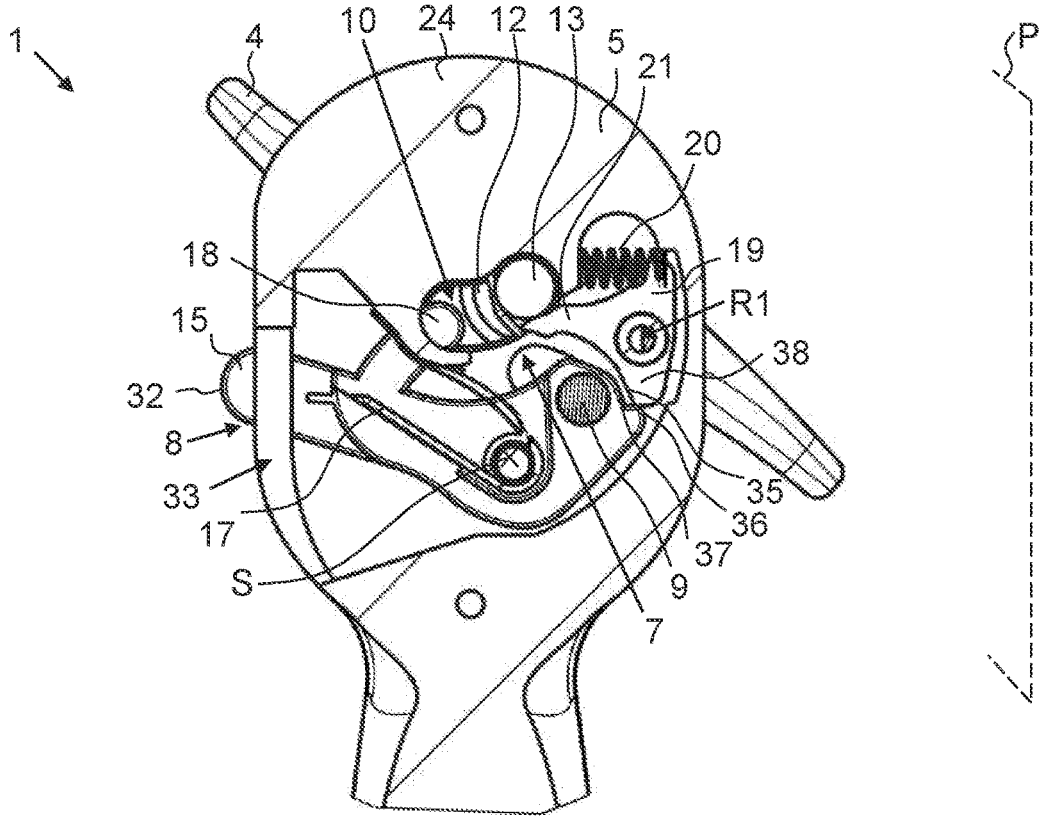
FIG. 6*b* shows a partial sectional view of the can opener according to FIG. 6*a* taken on the line indicated by arrow A in FIG. 4.
Figure 7B:
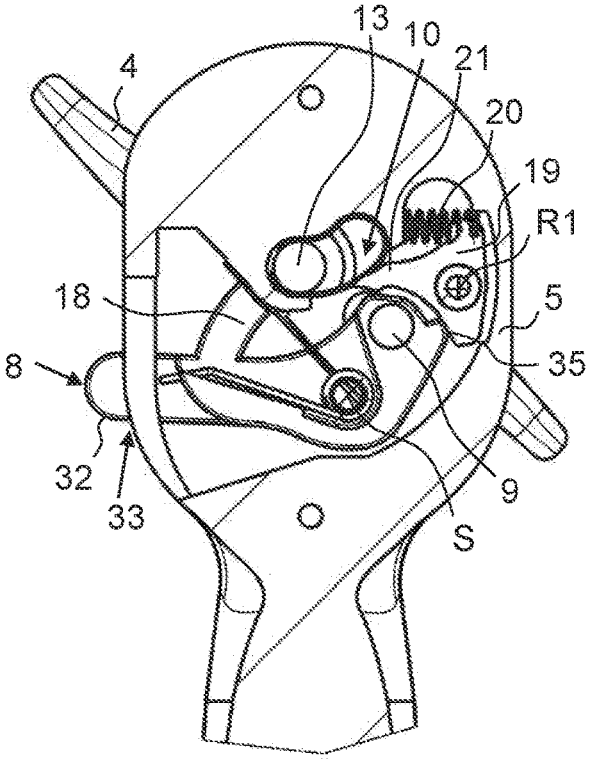
FIG. 7*b* shows a partial sectional view of the can opener according to FIG. 7*a* taken on the line indicated by arrow A in FIG. 4.
Figure 8B:
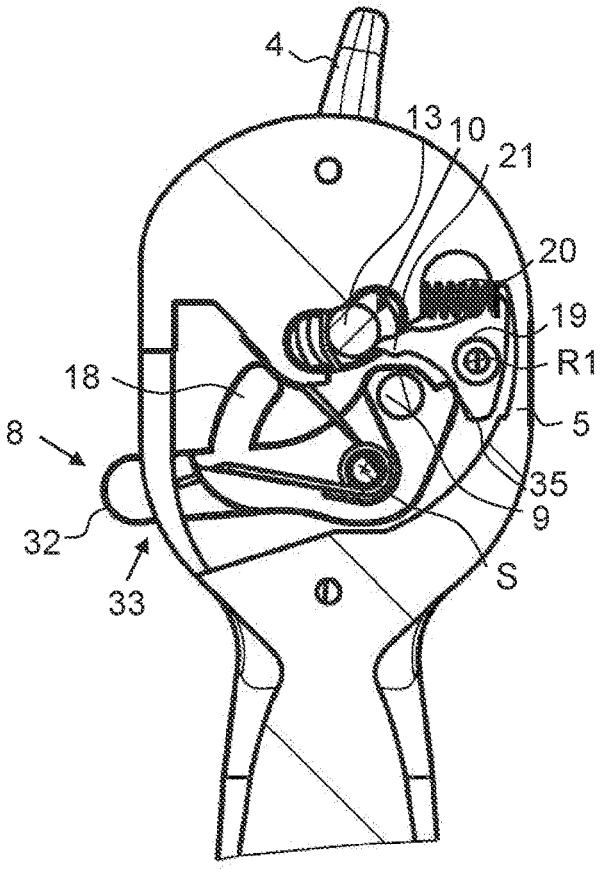
FIG. 8*b* shows a partial sectional view of the can opener according to FIG. 8*a* taken on the line indicated by arrow A in FIG. 4.

In order to assist a transfer of the traction device 6 from its traction device lifting position tl into its traction device release position tr the removal device 8 comprises an actuating element 18 in the form of a protruding arm that protrudes from the lever 15 towards the traction device 6, see FIGS. 6*b*, 7*b* and 8*b*. The actuating element 18 is configured and arranged such that, when the traction device 6 is in its traction device lifting position tl, it presses against the traction device 6 upon actuation of the removal device 8. It should be noted that this pressing force is in addition to the spring force being exerted by the traction device biasing means 34.

Figure 7C:
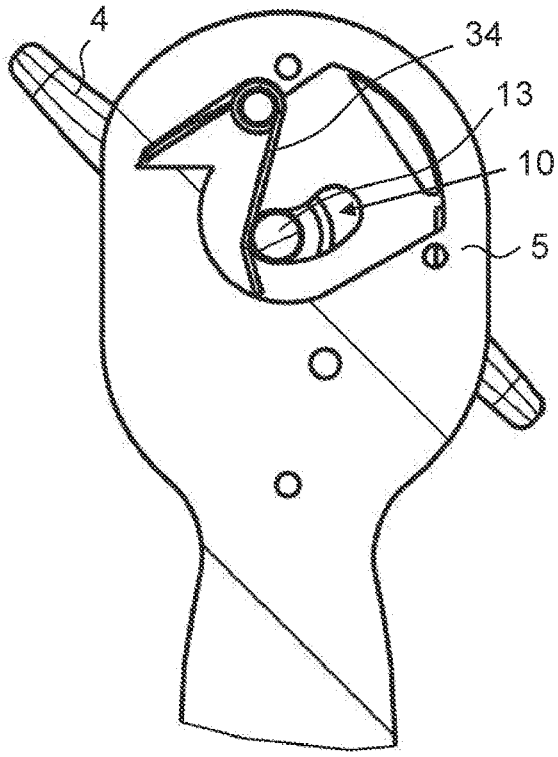
FIG. 7*c* shows a partial sectional view of the can opener according to FIG. 7*a* taken on the line indicated by arrow B in FIG. 4.

When the traction device 6 is in its traction device cutting position tc and the removal device 8 is in its removal device cutting position rc the can opener 1 is in its cutting position, see FIGS. 7*a* to 7*c*. As follows from a comparison between FIGS. 6*a* and 7*a*, the traction device 6 is moved towards and into proximity with the cutting device 7 upon rotation of the rotating device 4 along the first rotation direction r1. In doing so the traction wheel 22 is brought into proximity with the cutting wheel 25 such that the traction wheel 22 together with the cutting wheel 25 can act on a side wall of the can. If a user continues rotating the rotating device 4 along the first rotation direction r1 the side wall of the can 2 is drawn through a gap being established between the traction wheel 22 and the cutting wheel 25, whereby the side wall of the can 2 is progressively cut until the lid 3 is completely cut off from the can 2. As already explained, the engagement element 9 is displaceably arranged on the body 5 and is moved towards the cutting device 7 upon rotation of the rotating device 4 along the first rotation direction r1 when the removal device 8 is transferred into its removal device cutting position rc. In this position the engagement element 9 presses itself into a cutting edge along which the can 2 is cut by the traction device 6 and the cutting device 7, see FIG. 7*a*.

Figure 8C:
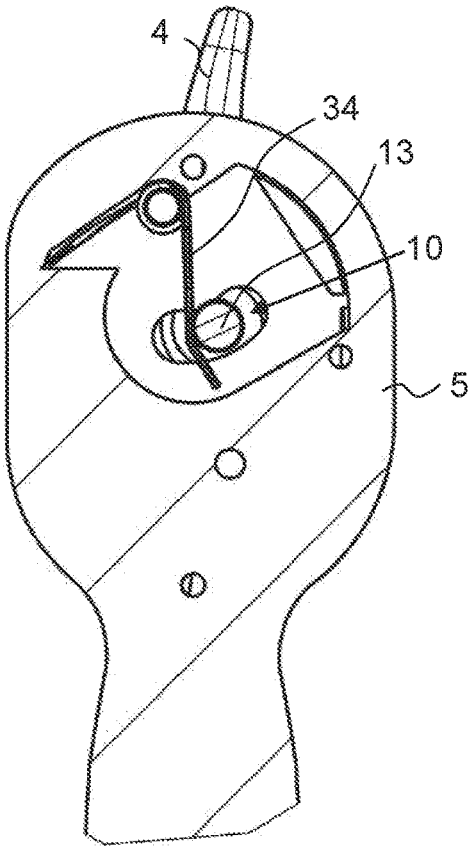
FIG. 8*c* shows a partial sectional view of the can opener according to FIG. 8*a* taken on the line indicated by arrow B in FIG. 4.

Upon completion of the cutting process, the rotating device 4 is rotated about the rotation axis R along the second rotation direction r2, whereby the can opener 1 is transferred from its cutting position into its lifting position, see FIGS. 8*a* to 8*c*. In the process, the traction device 6 and the engagement element 9 are moved away from the cutting device 7, compare FIGS. 7*a* and 8*a*. The traction device 6 in the traction device lifting position tl and the engagement element 9 in the removal device lifting position r1 are arranged in proximity to one another so as to engage the lid 3 of the opened can 2. This engagement allows the user to lift the lid 3 from the opened can 2 as it is depicted in FIG. 2.

Figure 6C:
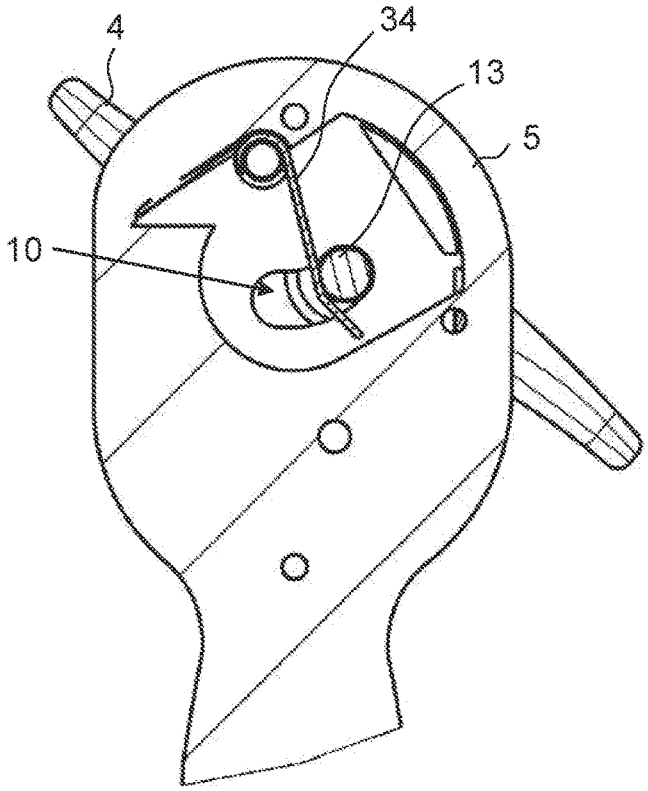

Upon actuation of the removal device 8 the traction device 6 is transferred into its traction device release position tr and the removal device 8 is transferred into its removal device release position rr, see FIGS. 6*a* to 6*c*. In this release position of the can opener 1 the engagement element 9 and the traction wheel 22 are moved away from one another, compare FIGS. 8*a* and 6*a*. In fact, in the release position of the can opener 1 the engagement between the traction wheel 22 and the engagement element 9 with the lid 3 is removed and, consequently, the lid 3 is released from the can opener 1.

Figure 9A:
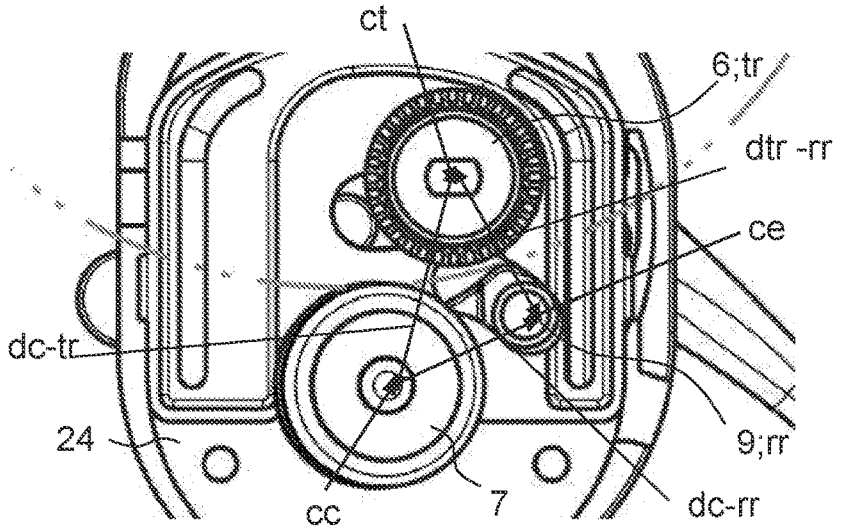
FIG. 9*a* shows a partial view of the can opener according to FIG. 6*a;*
Figure 9B:
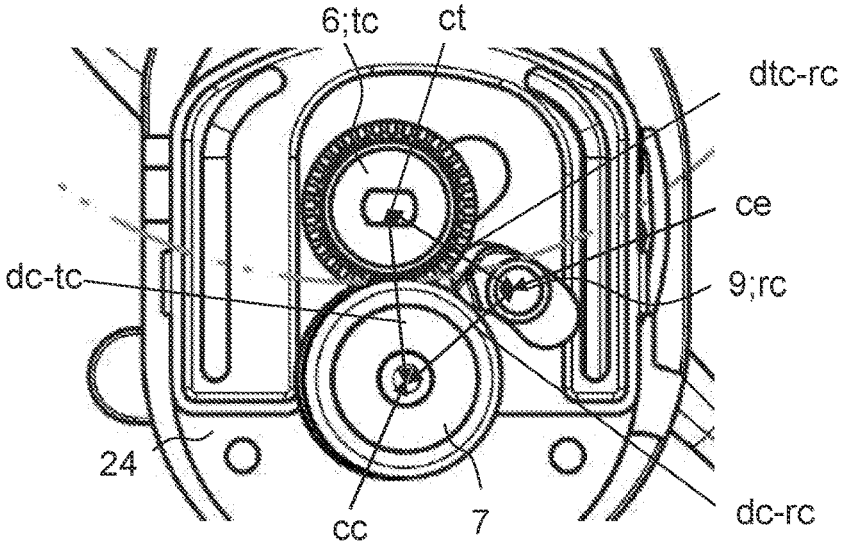
FIG. 9*b* shows a partial view of the can opener according to FIG. 7*a;*
Figure 9C:
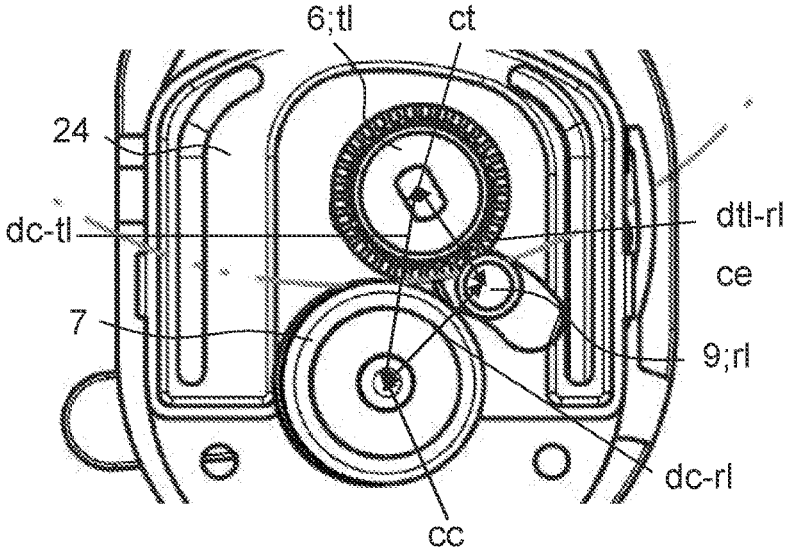
FIG. 9*c* shows a partial view of the can opener according to FIG. 8*a*.

As follows from a comparison between FIGS. 9*a* to 9*c*, a lateral distance dc-tc between the cutting device 7, in particular the cutting wheel 25, and the traction device 6, in particular the traction wheel 22, in the traction device cutting position tc is smaller than a lateral distance dc-tl between the cutting device 7 and the traction device 6, in particular the traction wheel 22, in the traction device lifting position tl. Moreover, a lateral distance dc-tl between the cutting device 7 and the traction device 6, in particular the traction wheel 22, in the traction device lifting position tl is smaller than a lateral distance dc-tr between the cutting device 7 and the traction device 6, in particular the traction wheel 22, in the traction device release position tr. A lateral distance dc-rc between the cutting device 7 and the engagement element 9 in the removal device cutting position rc is larger than a lateral distance dc-rl between the cutting device 7 and the engagement element 9 in the removal device lifting position. Additionally, a lateral distance dc-rl between the cutting device 7 and the engagement element 9 in the removal device lifting position rl is smaller than a lateral distance dtc-rr between the cutting device 7 and the engagement element 9 in the removal device release position rr. Furthermore, a lateral distance dtl-rl between the traction device 6, in particular the traction wheel 22, in the traction device lifting position tl and the engagement element 9 in the removal device lifting position rl is smaller than a lateral distance dtc-rc between the traction device 6, in particular the traction wheel 22, in the traction device cutting position tc and the engagement element 9 in the removal device cutting position. Moreover, a lateral distance dtl-rl between the traction device 6, in particular the traction wheel 22, in the traction device lifting position tl and the engagement element 9 in the removal device lifting position rl is smaller than a lateral distance dtr-rr between the traction device 6, in particular the traction wheel 22, in the traction device release position tr and the engagement element 9 in the removal device release position rr. The above-mentioned lateral distances are determined in each case between the respective figurative center points ct, cc, ce of the traction device 6, in particular of the traction wheel 22, the cutting device 7, in particular of the cutting wheel 25, and the engagement element 9, respectively.

The invention claimed is:

1. A can opener for opening a can comprising:

a rotating device, a body, a traction device, and a cutting device, wherein the rotating device is rotatably arranged on the body and is configured to rotate about a rotation axis along a first rotation direction and along a second rotation direction running opposite to the first rotation direction, wherein the traction device is arranged on the body and is configured to adapt at least a traction device cutting position upon rotation of the rotating device along the first rotation direction and to adapt a traction device lifting position upon rotation of the rotating device along the second rotation direction, wherein the traction device in the traction device cutting position and the cutting device are arranged so as to open a can, wherein the can opener further comprises a removal device comprising at least one engagement element, wherein the traction device in the traction device lifting position and the engagement element in a removal device lifting position are arranged such as to engage a lid of an opened can, and wherein the can opener is further configured such that an actuation of the removal device transfers the traction device into a traction device release position and the removal device into a removal device release position, whereby an engagement between the traction device and the engagement element with the lid is removed.

2. The can opener according to claim 1, wherein at least one of:

i) the engagement element is movably arranged on the body and is movable with respect to the body upon rotation of the rotating device about the rotation axis along the first rotation direction when the removal device is transferred into a removal device cutting position, wherein the engagement element is arranged such as to act on the can to be opened by the traction device in the traction device cutting position and the cutting device;

ii) the engagement element is movably arranged on the body and is movable with respect to the body upon rotation of the rotating device about the rotation axis along the second rotation direction when the removal device is transferred into the removal device lifting position; or iii) the engagement element is movable with respect to the body within a plane running perpendicularly to the rotation axis.

3. The can opener according to claim 1, wherein at least one of:

i) a lateral distance between the cutting device and the engagement element in the removal device cutting position is larger than a lateral distance between the cutting device and the engagement element in the removal device lifting position; or ii) a lateral distance between the cutting device and the engagement element in the removal device lifting position is smaller than a lateral distance between the cutting device and the engagement element in the removal device release position.

4. The can opener according to claim 1, wherein at least one of:

i) a lateral distance between the traction device in the traction device lifting position and the engagement element in the removal device lifting position is smaller than a lateral distance between the traction device in the traction device cutting position and the engagement element in the removal device cutting position; or ii) a lateral distance between the traction device in the traction device lifting position and the engagement element in the removal device lifting position is smaller than a lateral distance between the traction device in the traction device release position and the engagement element in the removal device release position.

5. The can opener according to claim 1, wherein the removal device is swivably arranged on the body and is configured to swivel about a swivelling axis running parallel to the rotation axis.

6. The can opener according to claim 1, wherein the removal device comprises a lever that is operatively connected to the engagement element such, that a swivelling of the lever moves the engagement element with respect to the body.

7. The can opener according to claim 1, further comprising at least one of:

i) a removal device biasing means that biases the removal device at least one of a) into the removal device cutting position and b) into the removal device lifting position; or ii) a traction device biasing means that biases the traction device into the traction device release position.

8. The can opener according to claim 1, further comprising an abutment device, wherein at least one of:

i) when the traction device is in its traction device release position, the abutment device adapts at least a first abutment position and abuts against the removal device, whereby the removal device remains in its removal device release position; or ii) wherein, upon rotation of the rotating device about the rotation axis along the first rotation direction the abutment device adapts an unblocking position, whereby the removal device is transferable into its removal device cutting position.

9. The can opener according to claim 8, wherein at least one of:

i) the abutment device is rotatable about a further rotation axis extending parallel to the rotation axis; or ii) the abutment device is non-displaceable with respect to the body.

10. The can opener according to claim 8, wherein at least one of:

i) the abutment device is configured and arranged such, that the traction device is transferable from its traction device lifting position into its traction device release position upon actuation of the removal device; or ii) wherein the abutment device is configured and arranged such, that it adapts a second abutment position when the traction device is in its traction device lifting position, whereby the abutment device prevents the traction device from being transferred into its traction device release position.

11. The can opener according to claim 8, further comprising an abutment device biasing means that biases the abutment device into its abutment position in the absence of a rotation of the rotating device.

12. The can opener according to claim 11, wherein the abutment device biasing means is attached to the body and the abutment device.

13. The can opener according to claim 8, wherein the abutment device comprises a trigger element that is in connection with the traction device when the traction device is in its traction device release position, and wherein at least one of:

i) the traction device presses against the trigger element upon rotation of the rotating device along the first rotation direction so as to displace the trigger element, whereby the abutment device is moved out of its abutment with the removal device; or ii) the trigger element abuts against the traction device when the traction device is in its traction device lifting position.

14. The can opener according to claim 8, wherein the abutment device adapts at least a first abutment position and abuts against the lever, whereby the removal device remains in its removal device release position.

15. The can opener according to claim 1, wherein the removal device comprises an actuating element, and wherein the actuating element is configured and arranged such that, when the traction device is in its traction device lifting position, it presses against the traction device upon actuation of the removal device.

16. The can opener according to claim 1, wherein at least one of:

i) the traction device is movably arranged on the body and is movable with respect to the body upon rotation of the rotating device about the rotation axis along at least one of i) the first rotation direction into the traction device cutting position and ii) along the second rotation direction into the traction device lifting position, ii) the traction device is movable with respect to the body within a plane running perpendicularly to the rotation axis, and; or iii) at least one of a) the cutting device is rotatably arranged on the body and is configured to rotate about a further rotation axis or b) the cutting device is non-displaceable with respect to the body.

17. A method of producing a can opener, the method comprising the steps of:

providing a rotating device, providing a body, providing a traction device, and providing a cutting device, wherein the rotating device is rotatably arranged on the body and is configured to rotate about a rotation axis along a first rotation direction and along a second rotation direction running opposite to the first rotation direction, wherein the traction device is arranged on the body and is configured to adapt at least a traction device cutting position upon rotation of the rotating device along the first rotation direction and to adapt a traction device lifting position upon rotation of the rotating device along the second rotation direction, wherein the traction device in the traction device cutting position and the cutting device are arranged so as to open a can, wherein the method further comprises the step of providing a removal device comprising at least one engagement element, wherein the traction device in the traction device lifting position and the engagement element in a removal device lifting position are arranged such as to engage a lid of an opened can, and wherein the can opener is further configured such that an actuation of the removal device transfers the traction device into a traction device release position and the removal device into a removal device release position, whereby an engagement between the traction device and the engagement element with the lid is removed.

* * * * *